US009672802B2

(12) United States Patent
Muzzio

(10) Patent No.: US 9,672,802 B2
(45) Date of Patent: Jun. 6, 2017

(54) ELECTRONIC DRUMS

(71) Applicant: John Muzzio, Encinitas, CA (US)

(72) Inventor: John Muzzio, Encinitas, CA (US)

( * ) Notice: Subject to any disclaimer, the term of this patent is extended or adjusted under 35 U.S.C. 154(b) by 0 days.

(21) Appl. No.: 15/014,887

(22) Filed: Feb. 3, 2016

(65) Prior Publication Data

US 2016/0225361 A1 Aug. 4, 2016

Related U.S. Application Data

(60) Provisional application No. 62/111,932, filed on Feb. 4, 2015.

(51) Int. Cl.

| | |
|---|---|
| ***G10H 1/34*** | (2006.01) |
| ***G10H 3/14*** | (2006.01) |
| ***G10D 13/02*** | (2006.01) |

(52) U.S. Cl.

CPC ..... *G10H 3/146* (2013.01); *G10D 13/024* (2013.01); *G10H 3/14* (2013.01)

(58) Field of Classification Search

CPC ..... G10H 3/14
USPC ..... 84/725
See application file for complete search history.

(56) References Cited

U.S. PATENT DOCUMENTS 3,553,339 A * 1/1971 Dominguez ..... G10H 3/146 84/725
5,223,654 A * 6/1993 Fujita ..... G10H 1/34 84/627
5,430,245 A * 7/1995 Rogers ..... G10H 3/146 84/725
5,710,387 A * 1/1998 Szalay ..... G10H 1/057 84/663
6,121,538 A 9/2000 Yoshino et al.
6,271,458 B1 8/2001 Yoshino et al.
6,365,812 B1 * 4/2002 McGill ..... G10D 13/027 84/413
6,632,989 B2 10/2003 Yoshino et al.
6,756,535 B1 6/2004 Yoshino et al.
6,881,885 B2 4/2005 Yoshino et al.
6,921,857 B2 7/2005 Yoshino et al.
7,297,863 B2 * 11/2007 May ..... G10H 1/32 84/104
7,381,885 B2 * 6/2008 Arimoto ..... G10H 1/0008 84/723
7,385,135 B2 6/2008 Yoshino et al.
7,459,626 B2 12/2008 Yoshino et al.
7,618,322 B2 * 11/2009 Shimizu ..... A63F 13/06 273/460
8,022,290 B2 * 9/2011 Masaki ..... G10H 1/16 84/730
8,563,843 B1 * 10/2013 Shemesh ..... G10H 7/00 84/723
2010/0107858 A1 * 5/2010 Peavey ..... G10D 13/021 84/725
2011/0296975 A1 * 12/2011 de Jong ..... G10H 1/0555 84/725
2013/0152768 A1 * 6/2013 Rapp ..... G10H 3/125 84/634

(Continued)

*Primary Examiner* — David Warren
(74) *Attorney, Agent, or Firm* — Greenblum & Bernstein, P.L.C.

(57) ABSTRACT

An electronic drum having a shell, a drum head mounted to the shell, and at least one distance detector arranged below the drum head and configured to detect and quantify a change in distance between the distance detector and the drum head.

20 Claims, 16 Drawing Sheets

(56) References Cited

U.S. PATENT DOCUMENTS

| | | | | |
|---|---|---|---|---|
| 2013/0312585 | A1* | 11/2013 | Yunbin | G10D 13/027 84/414 |
| 2013/0312590 | A1* | 11/2013 | Truchsess | G10H 3/146 84/725 |
| 2013/0340598 | A1* | 12/2013 | Marquez | G10H 1/0558 84/730 |
| 2016/0093278 | A1* | 3/2016 | Esparza | G10H 3/146 84/615 |
| 2016/0140945 | A1* | 5/2016 | De Virgiliis | G10H 3/146 84/725 |

* cited by examiner

ELECTRONIC DRUMS

CROSS-REFERENCE TO RELATED APPLICATION

The present application claims the benefit of U.S. Provisional Application No. 62/111,932, filed Feb. 4, 2015, the contents of which are expressly incorporated herein by reference in its entirety.

FIELD OF THE DISCLOSURE

The present disclosure relates to improved electronic drums, and more specifically, the present disclosure relates to electronic drums that have improved sensitivity, dynamic range, in a unique configuration.

BACKGROUND OF THE DISCLOSURE

In the following discussion, certain drumming and percussion systems will be described for background and introductory purposes. Nothing contained herein is to be construed as an "admission" of prior art. Applicant expressly reserves the right to demonstrate, where appropriate, that the articles and methods referenced herein do not constitute prior art under the applicable statutory provisions.

Acoustic drums include at least one membrane, called a drum head or drum skin, which is stretched over a shell and struck, either directly with the player's hands, or with a drum stick, for example, to produce sound. Electronic drums are intended to mimic the playability and feel of acoustic drums, and are connected to a sound generator and an amplifier in order to produce the sound of the drum. Thus, an advantage of the electronic drums over acoustic drums is that the volume of the electronic drums can more easily be controlled and adjusted (e.g., by turning up or down the volume of the amplifier and/or by utilizing headphones).

Electronic drums utilizing various drum heads, and sensors systems are known in the art. These drums generally include a shell (manufactured from various materials) supporting a drumhead using a drum hoop. The hoop allows for proper tensioning of the head. Known systems also include a sensor system that contacts the head to allow the vibrations from the drum head being stuck to transmit that energy to the sensor. The sensor is operable to convert the vibrational energy into an electrical signal, which is used to produce a sound when the electrical drum is impacted.

Performance issues arise with current electronic drums. For example, drum head response is not ideal with electronic drums (as compared to acoustic drums). With current electronic drum head technology, the head response is different than with real acoustic drums, which can cause a misleading performance as the drummer attempts to compensate for the problems with the heads. For example, electronic drums may utilize a rubber based surface material or a single or two ply drumhead mesh material. These materials, however, when struck, may cause the drumstick to bounce off the head in an un-natural fashion and/or may cause an undesirable spring effect.

When rubber is used as a head material, this material may cause a drum stick to become "stuck." (e.g., momentarily). For example, rubber will form a notch in the surface when struck by a drum stick, which causes a temporary "capture" of the stick, which may cause the drummer to pull away from the surface in an un-natural way. Drummers typically rely on stick bounce that induced from the cantilever effect of striking with a stick. Because of this un-natural playing, fatigue quite often is experienced when playing on rubber surface.

An additional drawback of playing on a rubber surface results when an angled attack is used, wherein the angle of incident from where the pad is struck in relation to where the initial stroke occurs does not naturally relate to the exit of the stick. Since the tip of the drumstick is "captured," if the drum is played from an angled attack that is not straight up and down, the drummer must wait for the stick to release from the same angle of attack then force back to the ended exit attack. This compensation causes the drummer an un-natural performance with added fatigue.

Additionally, although they may be quieter in play than rubber heads, there are drawbacks and issues with an electronic drum utilizing mesh heads. Typically, the mesh head is produced in either single or dual ply heads, the dual head design calls for the same material for both plies. With this approach, the head produces too much bounce, which may be counter-intuitive to how a drummer plays an acoustic head. For example, when a stroke is played on a mesh head, the stick will rebound at a rate that may be too fast, once again leaving the drummer to compensate and adjust his normal way of playing.

For example, it has been reported by drummers that playing on these surfaces causes fatigue to the drummer. This fatigue is produced from at least one of two sources: (1) in the case of rubber, when the drum head is struck with the stick, a pocket is formed in the rubber causing the stick to be caught in the "pocket", thus causing a slower response, and may return the stroke at an unnatural angle, thus causing the drummer to overplay the stroke; and (2) with a mesh-based head, when the drum head is struck with the stick, the drum head may cause too much spring return from the initial stroke, thus causing an un-natural strain on the drummers wrist and forearm.

Typically acoustic drums are tuned at different tensions. For example, a bass drum and floor torn may typically be tuned lower to produce a lower tone, which places the drumhead at a lower tension. In contrast, the snare drum and higher toms may typically be tuned higher with a tighter tension. With mesh heads, however, is may be more difficult to properly tune a drum requiring a tension other than a high tension (e.g., a bass drum that utilizes a lower tension to produce bass tones). This limitation forces the drummer to play every drum using a two-layer mesh head as it was a snare drum (very tight), which again causes an un-natural performance and may cause a drummer compensate, affecting the performance and playing style.

There are additional drawbacks with drum tonality on electronic drums. Acoustic drums will react in both feel and sonically differently depending on where on the drumhead is struck. For example, striking the middle (or center) of the drum head may produce different tones than striking the edge of the drum head. The drummer's performance expression relies greatly on where the drum is struck. Current electronic drum designs, however, do not address these regions of different tone accurately. Typically, electronic drums utilize a single Piezo ceramic material (sensor) for picking up vibrations across the head. By utilizing a single Piezo sensor, however, only one sound may be produced by the electronic drum no matter where the drum head is struck. This deficiency of electronic drums results in an un-natural performance. Due to these drawbacks and issues encountered with current electronic drums, these drums are looked upon as a necessity (e.g., for quiet play), and are not sought out for a desired playing experience.

Thus, there is a need in the art for an improved electronic drum that more accurately mimics the playability, feel and sound of an acoustic drum.

SUMMARY OF EMBODIMENTS OF THE DISCLOSURE

Aspects of the disclosure are directed to an electronic drum comprising a shell, a drum head mounted to the shell, and at least one distance detector arranged below the drum head and configured to detect and quantify a change in distance between the distance detector and the drum head.

In embodiments, the distance detector comprises at least one inductive coil.

In further embodiments, the drum head comprises a three-ply structure.

In additional embodiments, the drum head comprises a conductive layer.

In yet further embodiments, the conductive layer is arranged on an internal surface of the drum head.

In embodiments, the conductive layer comprises a silver mesh layer.

In further embodiments, the at least one inductive coil comprises a plurality of inductive coils arranged to delineate a plurality of impact detection zones of the distance detector.

In additional embodiments, the plurality of impact detection zones comprise a plurality of concentric circles.

In yet further embodiments, the plurality of impact detection zones comprise a plurality of quadrants.

In embodiments, the drum further comprises a processor configured to receive a detected distance and convert the detected distance to a volume signal.

In further embodiments, the drum further comprises a sound generator operable to receive the volume signal and output a sound based on the volume signal.

In additional embodiments, the processor is additionally configured to receive a detected impact zone and convert the detected impact zone to a sound-type signal.

In yet further embodiments, the drum further comprises a sound generator operable to receive the volume signal and the sound-type signal and output a sound based on the volume signal and the sound-type signal.

In embodiments, the change in distance is measurable when the drum head is impacted.

In further embodiments, the change in distance is measurable for each drum stroke impact with the drum head.

In additional embodiments, the at least one distance detector is configured with a measurement resolution in the picometer range.

In yet further embodiments, the at least one distance detector comprises a circuit configured to measure changes in inductance.

In embodiments, the drum head comprises a three-ply structure with a first layer and a third layer of a first material and a second layer comprising a second material that is different than the first material, and a conductive layer comprising a wire mesh adhered to the three-ply structure.

Additional aspects of the disclosure are directed to a method of producing a sound comprising measuring a change in distance between an impact-receiving material and a detection surface spaced from the impact-receiving material due to an impact to the impact-receiving material, converting the measured change in distance to sound volume quantification data using a processor, and producing the sound at least partially in dependence upon the sound volume quantification data.

In additional embodiments, the method further comprises detecting an impact zone for the impact to the impact-receiving material, converting the detected impact zone to sound type data using the processor, and producing the sound at least partially in dependence upon the sound type data.

BRIEF DESCRIPTION OF THE FIGURES

The novel features which are characteristic of the systems, both as to structure and method of operation thereof, together with further aims and advantages thereof, will be understood from the following description, considered in connection with the accompanying drawings, in which embodiments of the system are illustrated by way of example. It is to be expressly understood, however, that the drawings are for the purpose of illustration and description only, and they are not intended as a definition of the limits of the system. For a more complete understanding of the disclosure, as well as other aims and further features thereof, reference may be had to the following detailed description of the disclosure in conjunction with the following exemplary and non-limiting drawings wherein.

DETAILED DESCRIPTION OF EMBODIMENTS OF THE DISCLOSURE

Figure 1:
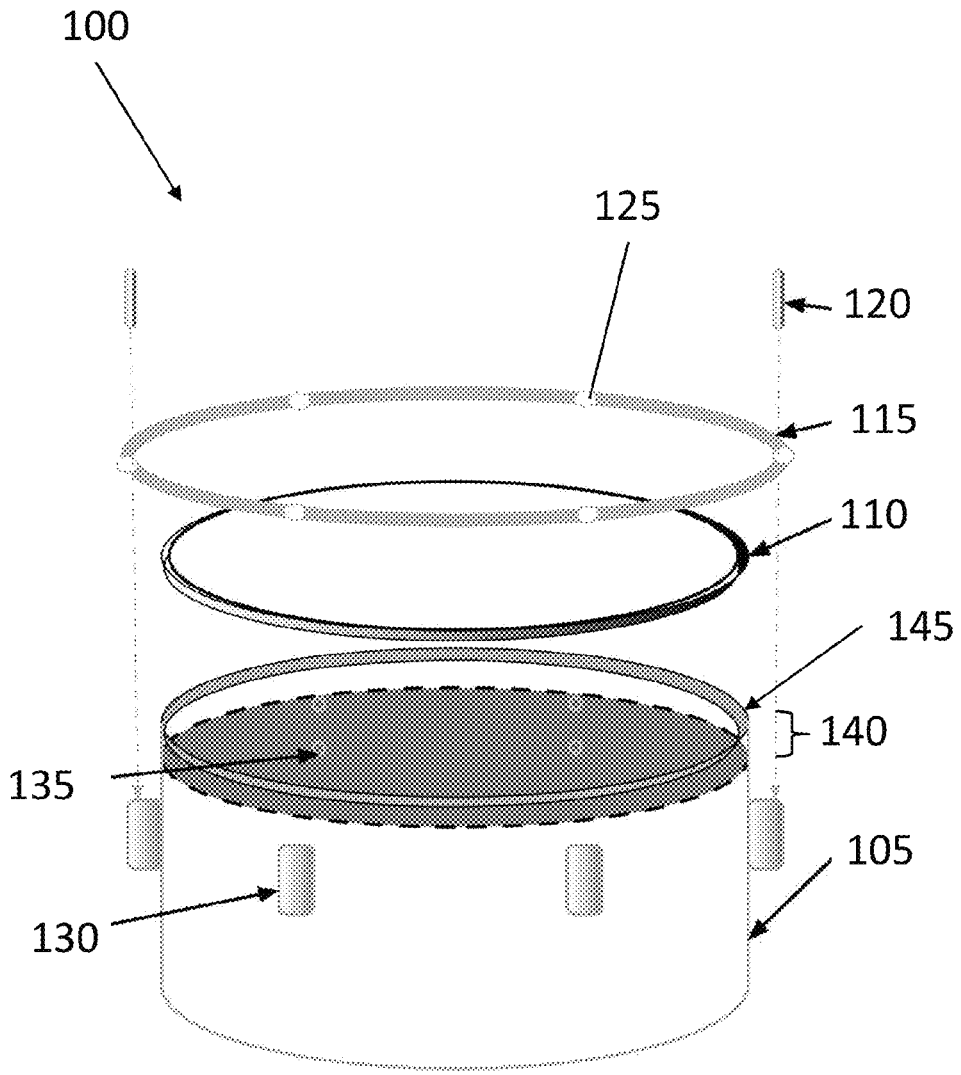
FIG. 1 is an exploded view of an exemplary drum in accordance with aspects of the disclosure.

In the following description, the various embodiments of the present disclosure will be described with respect to the enclosed drawings. As required, detailed embodiments of the embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions (unless otherwise explicitly indicated).

Unless otherwise defined, all technical and scientific teens used herein have the same meaning as commonly understood by one of ordinary skill in the art to which this disclosure belongs. The terminology used in the description of the disclosure herein is for describing particular embodiments only and is not intended to be limiting of the invention. As used in the description of the embodiments of the disclosure and the appended claims, the singular forms "a," "an," and "the" are intended to include the plural forms as well, unless the context clearly indicates otherwise. All publications, patent applications, patents, and other references mentioned herein are expressly incorporated by reference in their entirety.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Every numerical range given throughout this specification will include every narrower numerical range that falls within such broader numerical range, as if such narrower numerical ranges were all expressly written herein (unless otherwise explicitly indicated). For example, if a range is from about 1 to about 50, it is deemed to include, for example, 1, 7, 34, 46.1, 23.7, or any other value or range within the range.

Additional advantages of the disclosure will be set forth in part in the description which follows, and in part will be obvious from the description, or may be learned by practice of the disclosure. It is to be understood that both the foregoing general description and the following detailed description are exemplary and explanatory only and are not restrictive of the disclosure, as claimed. The various embodiments disclosed herein can be used separately and in various combinations unless specifically stated to the contrary.

This Summary is provided to introduce a selection of concepts in a simplified form that are further described in the Detailed Description. This Summary is not intended to identify key or essential features of the claimed subject matter, nor is it intended to be used to limit the scope of the claimed subject matter. Other features, details, utilities, and advantages of the claimed subject matter will be apparent from the Detailed Description herein including those aspects illustrated in the accompanying drawings and defined in the appended claims.

The present disclosure relates to an improved electronic drum; specifically, the present disclosure relates to electronic drum that allows for natural play, reduced fatigue, highly sensitive, and look of a real acoustic based drum. The disclosure addresses the current shortcomings and drawbacks experienced with electronic drums (e.g., non-realistic performance and non-realistic appearance), with a novel approach in head, sensor design, and mounting techniques.

FIG. 1 illustrates an exploded view of an exemplary drum in accordance with aspects of the disclosure. In accordance with aspects of the disclosure, the drum utilizes field reactance to detect the location and magnitude (or intensity) of a drum strike in order to produce an accurate or appropriate (and/or desired) drum tone.

As shown in FIG. 1, a drum 100 includes a drum shell 105. In embodiments, the drum shell 105 may comprise wood (e.g., walnut, birch, and/or maple wood), plastic, or a composite material. With an exemplary and non-limiting embodiment, the drum shells utilize 100% all birch shells and utilize a staggered seam arrangement, which allows for strength and maintains the round shape of the shell. In embodiments, forty-five degree bearing edges 145 on the top of the drum shell are utilized to ensure proper head seating. In accordance with aspects of the disclosure, the utilization of a hardwood allows for the high gloss lacquer finish to be added to the drum allowing for a pleasing aesthetic result. A real wood shell may be employed for both aesthetic purposes, as well the benefit of maintaining a round shell (e.g., perfectly round shell) with a proper head seating area.

A drum head 110 is placed on the drum shell 105 and secured thereto (and tensioned) by placing a hoop or rim 115 over the drum head 110, and securing the hoop 115 to the drum shell 105 via a plurality of tension rods 120 that pass through holes 125 in the hoop 115 and fasten to correspondingly arranged drum lugs 130 securely attached to the drum shell 105.

As also shown in FIG. 1, the drum 100 includes a detector 135 securely arranged in the drum shell 105 so as to be spaced from the bottom of the drum head 110 by a distance 140. In embodiments, the distance 140 may be approximately one-half inch, with other distances contemplated by the disclosure. In accordance with aspects of the disclosure, the detector 135 may comprise a printed circuit board (PCB) layer having at least one layer of inductive material arranged to delineate different zones of the detector 135. In embodiments, the inductive material may be embedded in the PCB. In embodiments, the detector 135 comprises at least one inductive coil. In embodiments, the detector 135 comprises an active circuit configured to measure a change in inductance.

In further embodiments, the detector 135 comprises an inductive sensor (e.g., an inductive proximity switch or non-contact electronic sensors), which are operable to recognize any conducting metal target. For example, with an inductive sensor, an oscillator creates a high frequency electromagnetic field, which radiates from the sensing face of the switch. When a conductive metal object enters this electromagnetic field, eddy currents are induced within the metal, causing a change in the amplitude of the oscillations. The result is a voltage change at the output of the oscillator, which causes the trigger to change state and alter the output state. Inductive sensors with analog output signals are characterized by their short response times, high resolution and linearity as well as their outstanding repeat accuracy. The output current and voltage values of inductive sensors are proportional to the distance between the sensor and the object being detected. Inductive sensors represent absolute measured values corresponding to the distance between the active surface and the object.

In accordance with additional aspects of the disclosure, the drum head 110 comprises a laminate with a lower layer of conductive material that is structured and arranged to interact with the detector 135. The drum 100 employs a novel sound generation approach that comprises measuring the distance from a stroke hit on the drum head 110 (e.g., the location of the drum head in a vertical direction when the drum head is struck) to a fixed point on the detector 135 below the drum head 110. In accordance with aspects of the disclosure, the sensitivity of stroke is determined by accurately measuring the head deflection.

In embodiments, the detector 135 comprises an inductive proximity sensor and/or, for example, an Inductance-to-Digital Converter for Inductive Sensing, manufactured by Texas Instruments. In embodiments, the sensor or detector 135 includes at least one induction loop. Electric current generates a magnetic field, which collapses generating a current that falls toward zero from its initial state when the input electricity ceases. The inductance of the loop changes according to the material inside it and since metals are much more effective inductors than other materials the presence of metal increases the current flowing through the loop. This change can be detected by sensing circuitry, which can signal to some other device whenever metal is detected.

In embodiments, the drum (or at least some portions of the drum) may have an air-tight construction.

In accordance with aspects of the disclosure, this approach is capable of a measuring resolution (of a distance between the lower layer of conductive material and the detector 135) in the nanometer (nm) range and/or picometer range. The drum system additionally includes A/D electronics that are operable to convert the measured distance with very high resolution to accurately reproduce a wide dynamic range (e.g., softer drum hits to harder drum hits) typically found in drummers performance.

As mentioned above, with current electronic drums using a ceramic-based sensor (e.g., Piezo transducer), the transducer will generate a voltage proportional to the amount of vibration the sensor is subject to. Generally such a conventional arrangement produces voltages ranging from low milli-volt range to over 100V DC. With this wide range of voltages, the analog to digital conversion resolution necessary to convert the stroke accurately is difficult or more expensive to obtain with typical consumer electronics. Thus, with such a design, gaps in the sensitivity from softer to harder strokes is not attainable, and consequently, the dynamic range of the drummer is usually lost (or at least inaccurately produced).

By implementing aspects of the embodiments of the present disclosure, the drum is able to accurately reproduce a wide dynamic range (e.g., softer drum hits to harder drum hits) typically found in drummers performance.

Figure 2:
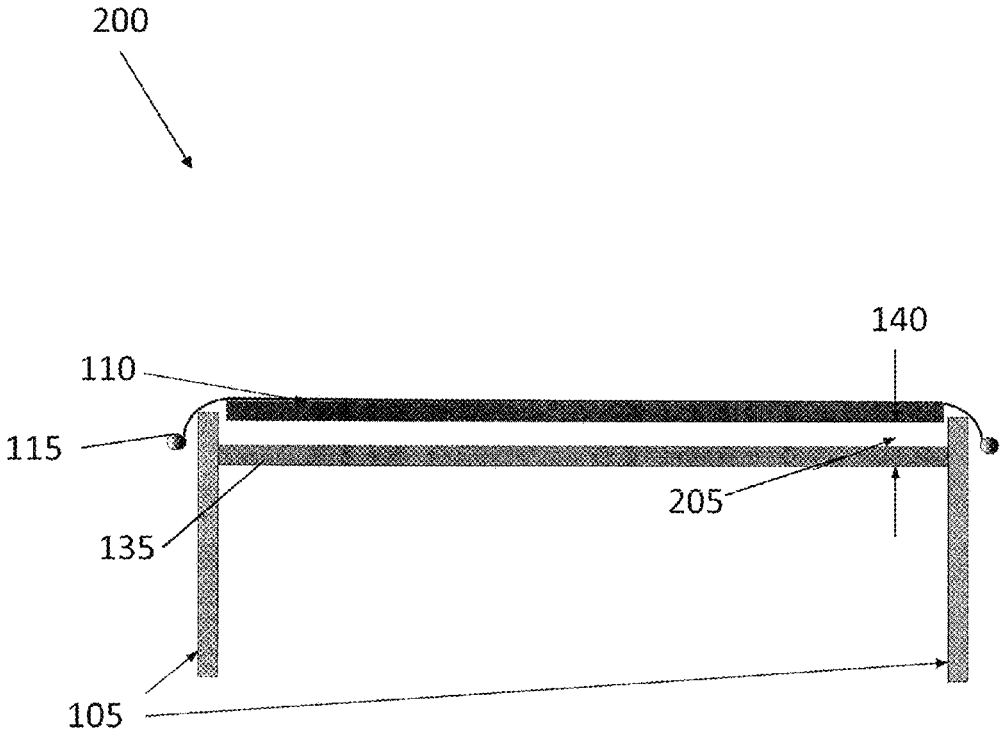
FIG. 2 is a schematic sectional view of a drum in accordance with aspects of the disclosure.

FIG. 2 illustrates a schematic sectional view of a drum 200 in accordance with aspects of the disclosure. As shown in FIG. 2, the drum 200 includes a drum shell 105 with a drum head 110 arranged on the drum shell 105. The drum head 110 is secured to the drum shell 105 (and tensioned) by placing a hoop or rim 115 over the drum head 110, and securing the hoop 115 to the drum shell 105 via a plurality of tension rods (not shown) structured and arranged to pass through holes (not shown) in the hoop 115 and fasten to correspondingly arranged drum lugs (not shown) securely attached to the drum shell 105.

As also shown in FIG. 2, the drum 200 includes a detector 135 securely arranged in the drum shell 105 so as to be spaced from the bottom of the drum head 110 by a known distance 140. Thus, as shown in FIG. 2, there is a gap or deflection area 205 between the drum head 110 and the detector 135 in which the drum head can deflect without contacting the detector 135. In accordance with aspects of the disclosure, the detector 135 may comprise a printed circuit board (PCB) layer having at least one layer of inductive material (e.g., at least one inductive coil) arranged to delineate different zones of the detector 135. The detector 135 may be securely attached to the drum shell 105 using adhesives, fasteners, welds, and/or any other suitable attachment. In some embodiments, the mounting of the PCB having the detector 135 may utilize additional holes drilled into the drum, while in further embodiments the detector mounting may utilize existing drum lugholes. Considerations for mounting the drum head 110 and the corresponding inductive detector (or sensor) 135, include maintaining a proper distance between the detector (or sensor) 135 and the drum head 110, and maintaining the look of an acoustic drum. The drum head 110 includes a flexible conductive layer (not shown) on the bottom side thereof that is structured and arranged to interact with the detector 135 (e.g., the inductive coils of the detector 135).

Figure 3:
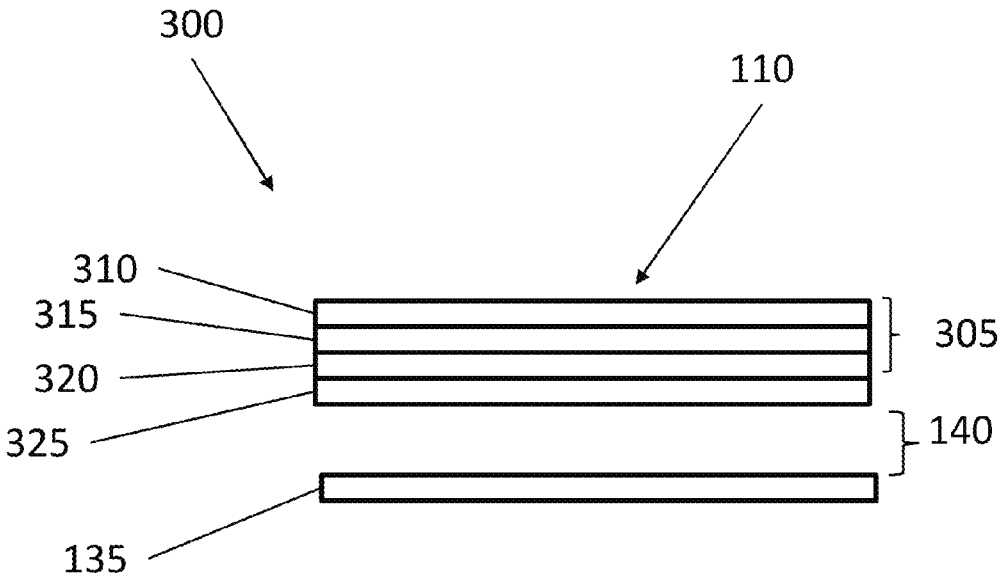
FIG. 3 is a schematic sectional view of elements of the drum head and inductive detector in accordance with aspects of the disclosure.

FIG. 3 illustrates a schematic sectional view 300 of elements of the drum head 110 and inductive detector 135 in accordance with aspects of the disclosure. As depicted in FIG. 3, the drum head 110 includes a three-ply head material 305 with an additional bottom layer comprising a flexible conductive material 325. The head may be designed and structured with a material that provides a realistic reaction to the stroke while maintaining a quiet mechanical sound when the drum is struck. In embodiments, the drum head 110 includes two types of polymer material layered, wherein the first layer 310 and third layer 320 are similar to each other, and the center layer 315 is a different material. For example, as described in more detail below, in some embodiments, the drum head 110 includes three plies of two material types (e.g., a first layer 310 and third layer 320 of a first material type, and a second layer 315 arranged between the first and second layer of a second material type). With an exemplary and non-limiting embodiment, a first layer 310 and the third layer 320 may comprise polyethylene terephthalate (resin of the polyester family and is used in synthetic fibers), and the second layer 315 may be trueran poplin (Polyester Pongee fabric). The disclosure contemplates, however, that other materials (e.g., other polymer materials) may be used.

In accordance with aspects of the disclosure, the flexible conductive layer 325 is attached to the bottom of the three-ply head 305. Like the three-ply drum head 305, the flexible conductive layer 325 is also structured and arranged to allow air to pass there through. In embodiments, the conductive layer 325 may be a copper mesh material, or some other suitably conductive and flexible material (e.g., silver). In embodiments, the conductive layer 325 may be attached to the bottom layer 320 of the three-ply head 305 using an adhesive (e.g., securely attaching portions of the conductive materials) so that the conductive layer 325 can flex (or deflect) with the other layers 310, 315, and 320 of the drum head 110.

As shown in FIG. 3, the detector 135 is fixedly arranged at a distance 140 from the bottom of the conductive layer 325. The detector 135 may include a PCB having at least one layer of inductive material that is structured and arranged to delineate one or more zones within the circular area of the drum.

As should be understood, when the drum head 110 is struck (e.g., with a drumstick), the distance between the conductive layer 325 and the detector 135 will momentarily change as the drum head 110 flexes (or deflects) towards the detector 135. In accordance with aspects of the disclosure, by measuring this distance (e.g., the peak distance), the magnitude of the impact can be determined. In embodiments, the measurement is made from the bottom of the flexible conductive layer 325 to the inductive patterns of the detector 135 on the PCB. In embodiments, this measured distance is then converted using a microcontroller (not shown), which is capable of and configured to handle multiple of these inputs simultaneously. These signals are then sent to a sound module (not shown) for sound assignment and processing.

By utilizing this approach, in accordance with aspects of the disclosure, the issues of real performance feel are maintained with these electronic drums, in that the head responds similarly to an acoustic head. The present disclosure also alleviates the issue of cross talk between two drums that occurs with piezo sensors, as the sensor design of the present disclosure is not based on vibration conversion. As described further below, the present disclosure also allows for a separate sensor (e.g., piezo sensor) to be used, e.g., with the rim of the drum with no crosstalk.

The combination and layering of the materials of the drum head 110 produces an accurate response and feel comparable to an acoustic drumming-like experience. This arrangement coupled with material type will allow for quiet play and a natural reaction to the drummer's stroke. In accordance with aspects of the disclosure, the drum head 110 will not catch the stick and will not make the stick bounce back too quickly.

Figure 4A:
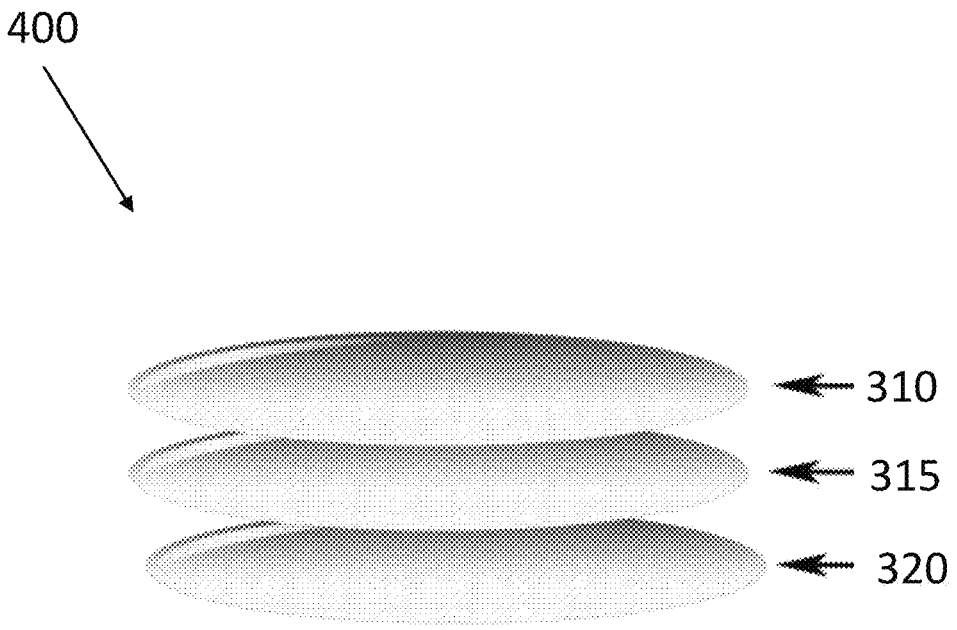
FIGS. 4A and 4B are schematic perspective views of layers of the 3-ply woven head design in accordance with aspects of the disclosure.
Figure 4B:
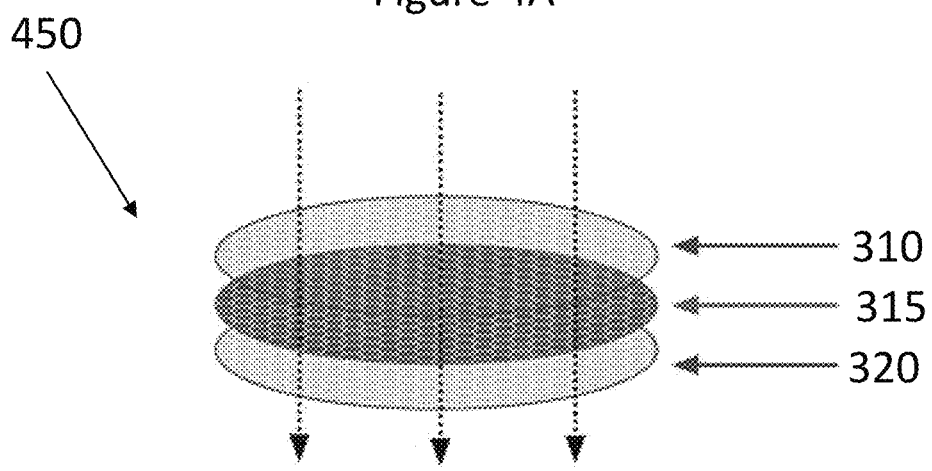

FIGS. 4A and 4B schematically illustrate arrangements 400 and 450 depicting the three layers of the three-ply head 305 of the drum head (not shown). In other words, FIGS. 4A and 4B schematically illustrate the three layers 310, 315, and 320 of the three-ply head 305 without the conductive layer 325. As shown in FIGS. 4A and 4B, each of the layers 310, 315, and 320 have an approximately congruent shape and size. As shown in FIG. 4B, in embodiments, the layers 310, 315, and 320 are mounted precisely, with the top layer 310 and the bottom layer 320 in-line with each other so the respective patterns of these two layers align, while the middle layer 315 is arranged such that a pattern is angularly offset (e.g., at 90 degrees) from a pattern of the top and bottom layers. In accordance with aspects of the disclosure, the layers 310, 315, and 320 include small holes or perforations therein, which allow air to pass through the drum head. By allowing air to pass through the holes in these layers 310, 315, and 320, the acoustic volume of an impact on the drum head is reduced (as compared to a conventional acoustic drum). In accordance with aspects of the disclosure, by utilizing a three-layer technique by combining two types of woven material, it is possible to generate a head that is quiet and at the same time has an authentic acoustic drum feel.

In accordance with further aspects of the disclosure, in some embodiments, the drum also allows for the possibility of creating multiple zones on one playing surface. For example, a drum can be configured to produce multiple sounds depending upon in which zone the impact was detected. In accordance with aspects of the disclosure, by utilizing these multiple zones, the constraint encountered with conventional electronic drums of only being able to produce one sound across the entire drum head may be eliminated. Utilizing zones enables a drummer to produce completely different drum tones in each of the different zones and/or enables a natural drum response of various tones (e.g., as the impact location varies from the center of the drum towards the edge of the drum) as occurs with acoustic drums. That is, the zones enable individual playing areas with assigned sounds that, for example, mimic the different tones produced on an acoustic drum. Additionally, the zones enable changes for various playing situations and creation of multi zoned percussion setups.

As noted above, the detector 135 may include a PCB having at least one layer of inductive material that is structured and arranged to delineate one or more zones within the circular area of the drum. In accordance with additional aspects of the disclosure, the detector 135 is operable to detect a location of the impact (e.g., in which zone the impact was received).

Figure 5:
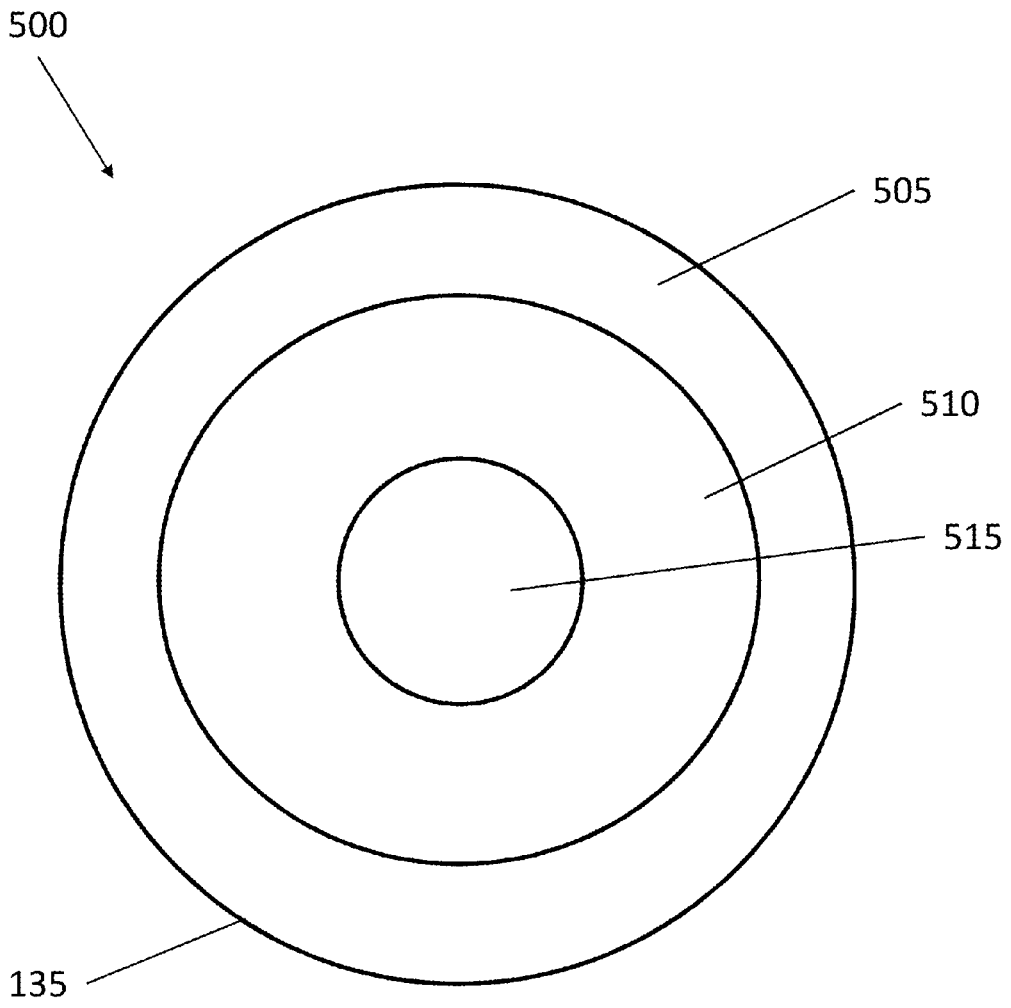
FIG. 5 is a schematic depiction of a zone arrangement for the inductive detector in accordance with aspects of the disclosure.

FIG. 5 schematically depicts an exemplary layout 500 of zones on a detector 135. As shown in FIG. 5, the detector 135 may be configured, for example, with three zones (e.g., an outer zone 505, a middle zone 510, and a central zone 515), which correspond to areas (or regions or zones) of the drum head 110. In embodiments, these various zones of the drum head 110 may be created by forming separate inductive zones on the PCB of the detector 135.

Figure 6:
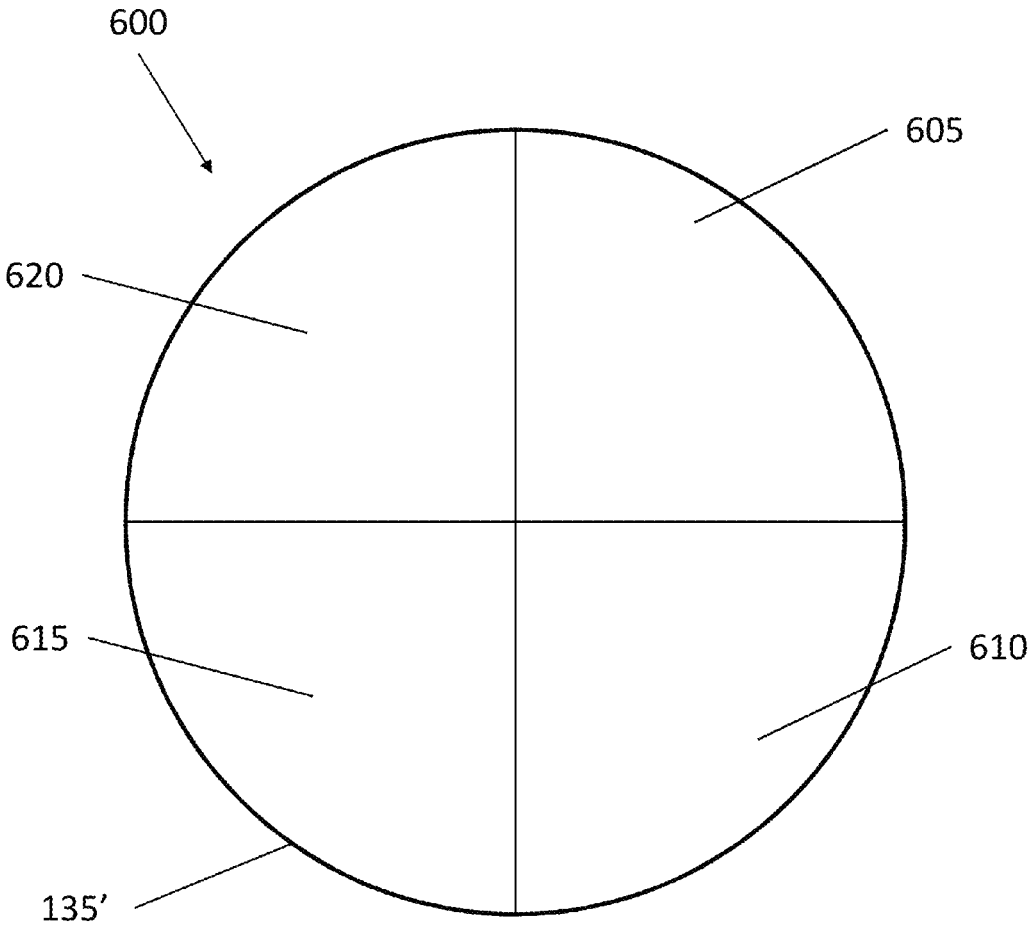
FIG. 6 is a schematic depiction of another zone arrangement for the inductive detector in accordance with aspects of the disclosure.

FIG. 6 schematically depicts another exemplary layout 600 of zones on a detector 135'. As shown in FIG. 6, with this exemplary embodiment, the drum head is zoned into four quadrants and the detector 135' may be configured, for example, with four corresponding zones (e.g., an upper right zone 605, an lower right zone 610, an upper left zone 620, and a lower left zone 615). In embodiments, these various zones of the drum head may be created by forming separate inductive zones 605, 610, 615, 620 on the PCB of the detector 135. It should be understood that these are just two examples of possibilities and the disclosure contemplates many other zone arrangements or shapes can be utilized, for example, based on a drummer's particular tastes and or needs.

Figure 7:
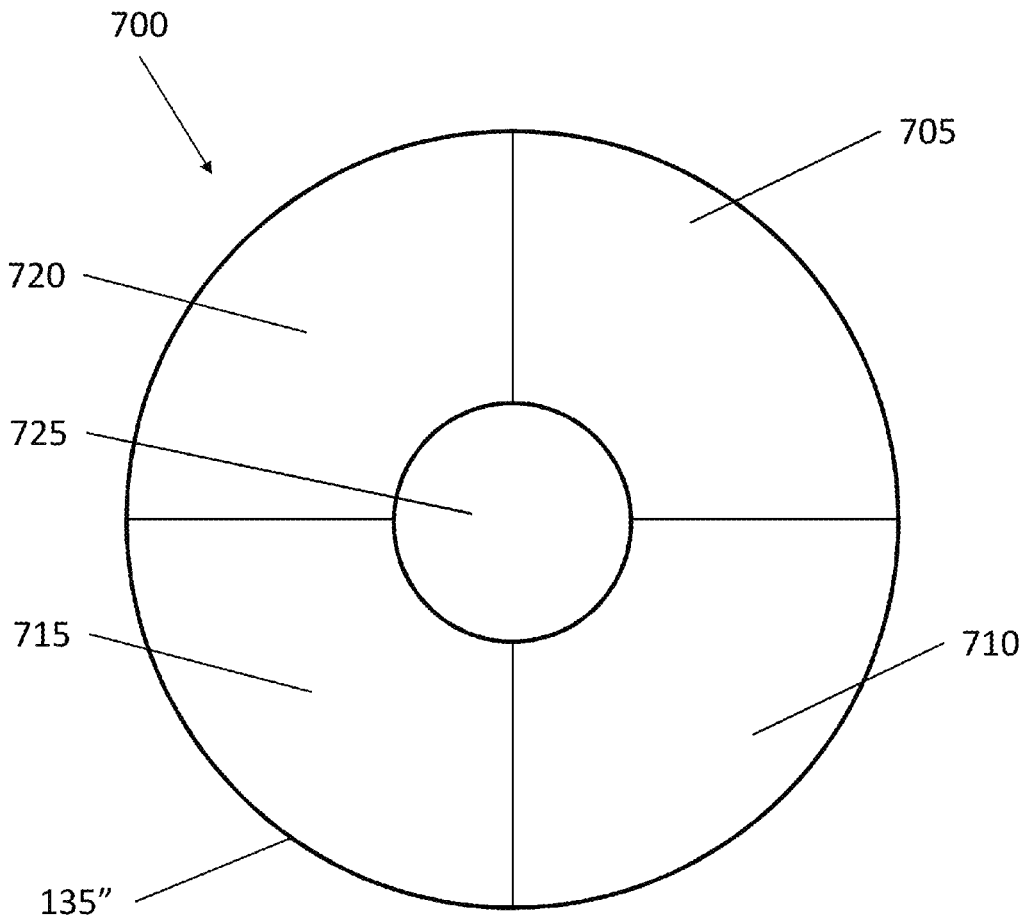
FIG. 7 is a schematic depiction of another zone arrangement for the inductive detector in accordance with aspects of the disclosure.

For example, FIG. 7 schematically depicts another contemplated zone layout 700 in accordance with aspects of the disclosure. As shown in FIG. 7, with this exemplary layout 700, the detector 135" may be configured, for example, with five corresponding zones (e.g., an upper right zone 705, an lower right zone 710, an upper left zone 720, a lower left zone 715; and a center zone 725).

Figure 8:
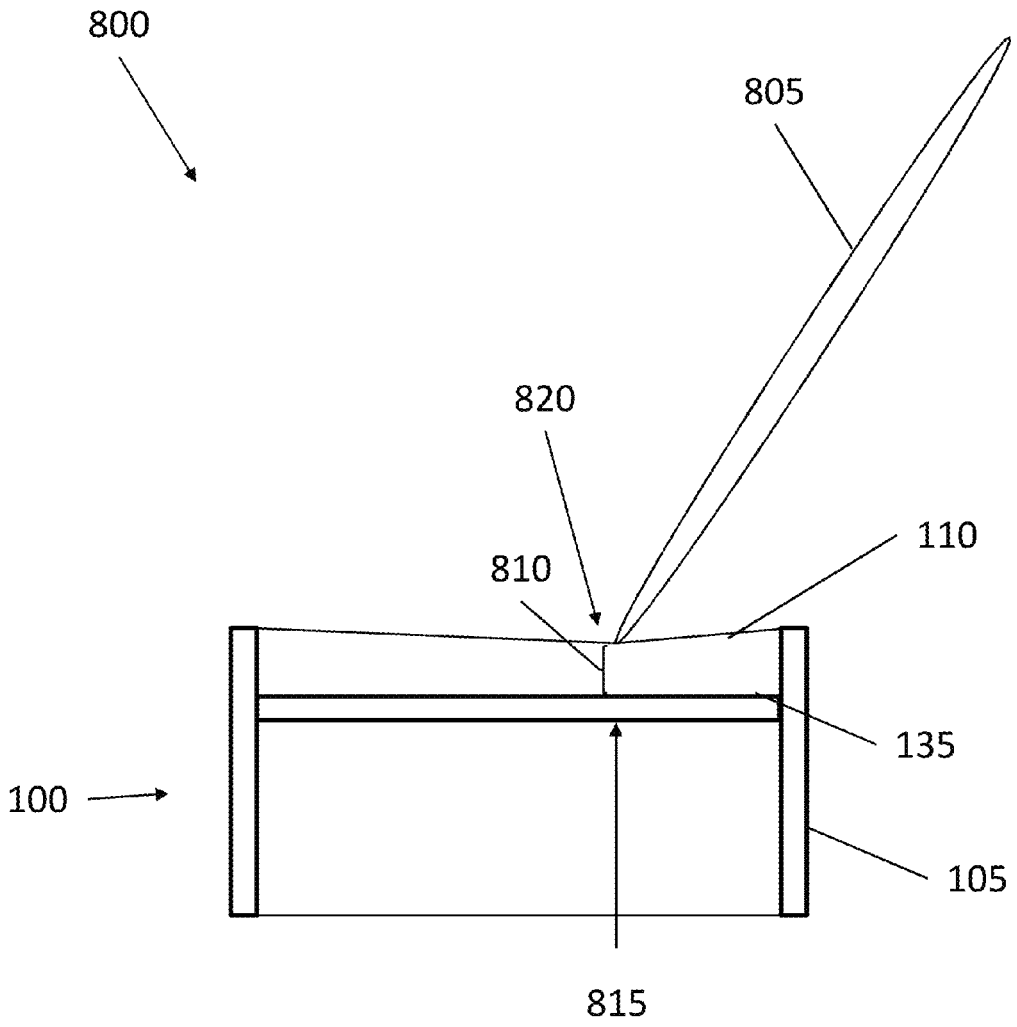
FIG. 8 is a schematic depiction of a drum stick impacting a drum in accordance with aspects of the disclosure.

FIG. 8 schematically depicts an arrangement 800 in which a drum stick 805 is impacting a drum head 110 of the drum 105. When the drum head is stationary (e.g., it has not been struck), the drum head 110 is at a distance 140 from the detector 135 (for example, as depicted in FIG. 2). As shown in FIG. 8, upon being impacted (e.g., by a drumstick 805), the drum head 110 is moved (e.g., deflected) downwardly at the impact site 820. The detector 135 is operable to measure the distance 810 between the inductive surface of the detector 135 and the flexible conductor (not shown) arranged on the lower side of the drum head 110 at the impact site 820. Additionally, if the drum utilizes a plurality of zones, the detector 135 is operable to determine the relative location 815 (in x and y directions) on the detector 135 corresponding to the impact site 820. Based on the measured distance 810, the drum 100 (in conjunction with a processor) is operable to determine a relative volume of the drum impact. For example, if the distance 810 is larger, the drum 100 is configured to produce a lower relative volume, and conversely, if the distance 810 is smaller, the drum 100 is configured to produce a higher relative volume. Additionally, in accordance with aspects of the disclosure, based on the identified impact site 820, the drum is operable to identify which zone was triggered, so as to produce the appropriate tone designated for that zone.

In accordance with aspects of the disclosure, as the impacts to the drum are generally in a vertical direction, the detector 135 is operable to detect the relative location 815 (in x and y directions) without cross talk. That is, as a drumstick impact site 820 on the drum head 110 will only correspond to a single underlying zone on the detector 135, the embodiments of the present disclosure are able to reduce (or eliminate) any cross-talk (e.g., false triggering of multiple zones).

Figure 9:
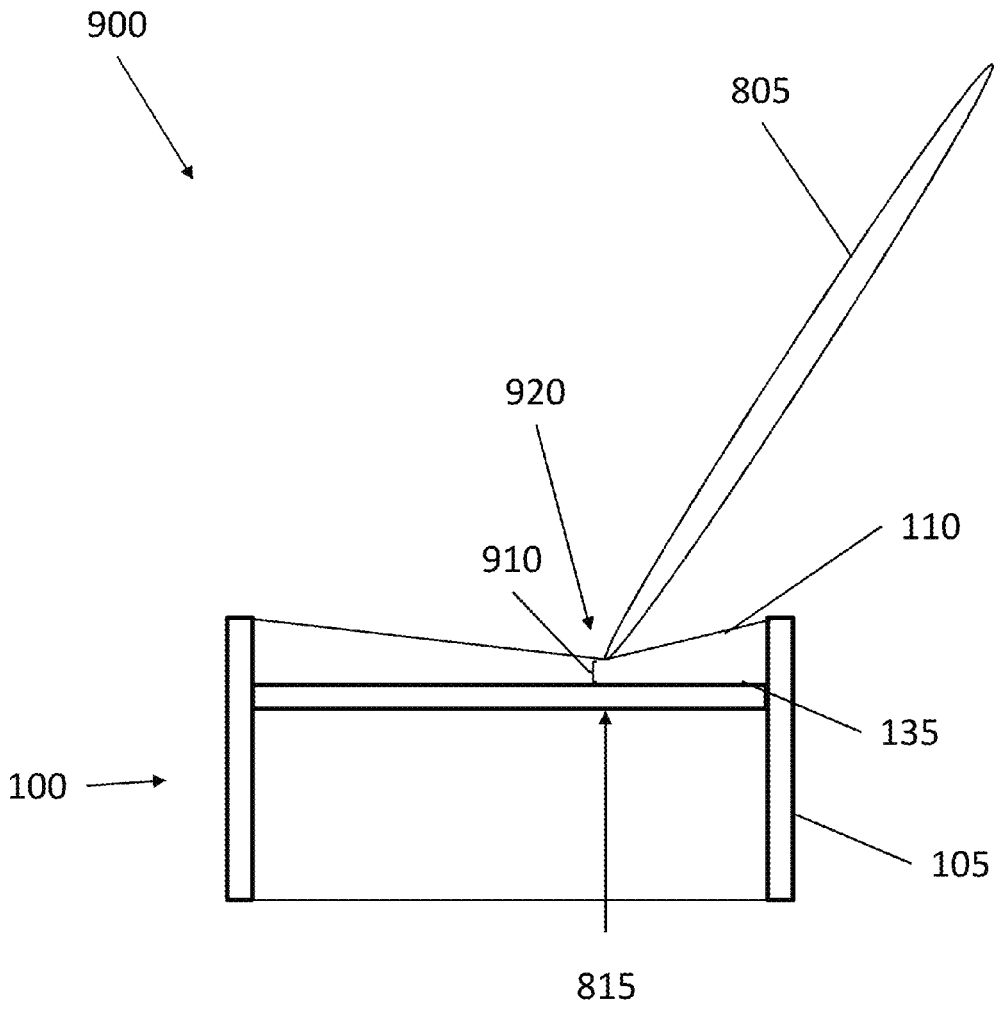
FIG. 9 is another schematic depiction of a drum stick impacting a drum in accordance with aspects of the disclosure.

FIG. 9 schematically depicts another arrangement 900 in which a drum stick 805 is impacting a drum head 110 of the drum 105. As shown in FIG. 9, upon being impacted (e.g., by a drumstick 805), the drum head 110 is moved downwardly (e.g., deflected) at the impact site 920. The detector 135 is operable to measure the distance 910 between the inductive surface of the detector 135 and the flexible conductor (not shown) arranged on the lower side of the drum head 110. Additionally, if the drum utilizes a plurality of zones, the detector 135 is operable to determine the relative location 815 (in x and y directions) of the impact site. Based on the measured distance 910, the drum (in conjunction with a processor) is operable to determine a relative volume of the drum impact.

In comparison to FIG. 8, with FIG. 9, the drum has been impacted harder, and thus, distance 910 is smaller than distance 810. As can also be observed, the impact location is approximately the same between FIGS. 8 and 9. Accordingly, with the example of FIG. 9, the sound creation processor (not shown), which is operable to produce the sounds based on the received inputs, will produce a relatively louder drum sound than with the exemplary depiction of FIG. 8. As an impact occurs within the same zone in FIGS. 8 and 9, however, the sound creation processor (not shown) will produce the same sound-type for both FIGS. 8 and 9 based on the impact zone.

Figure 10:
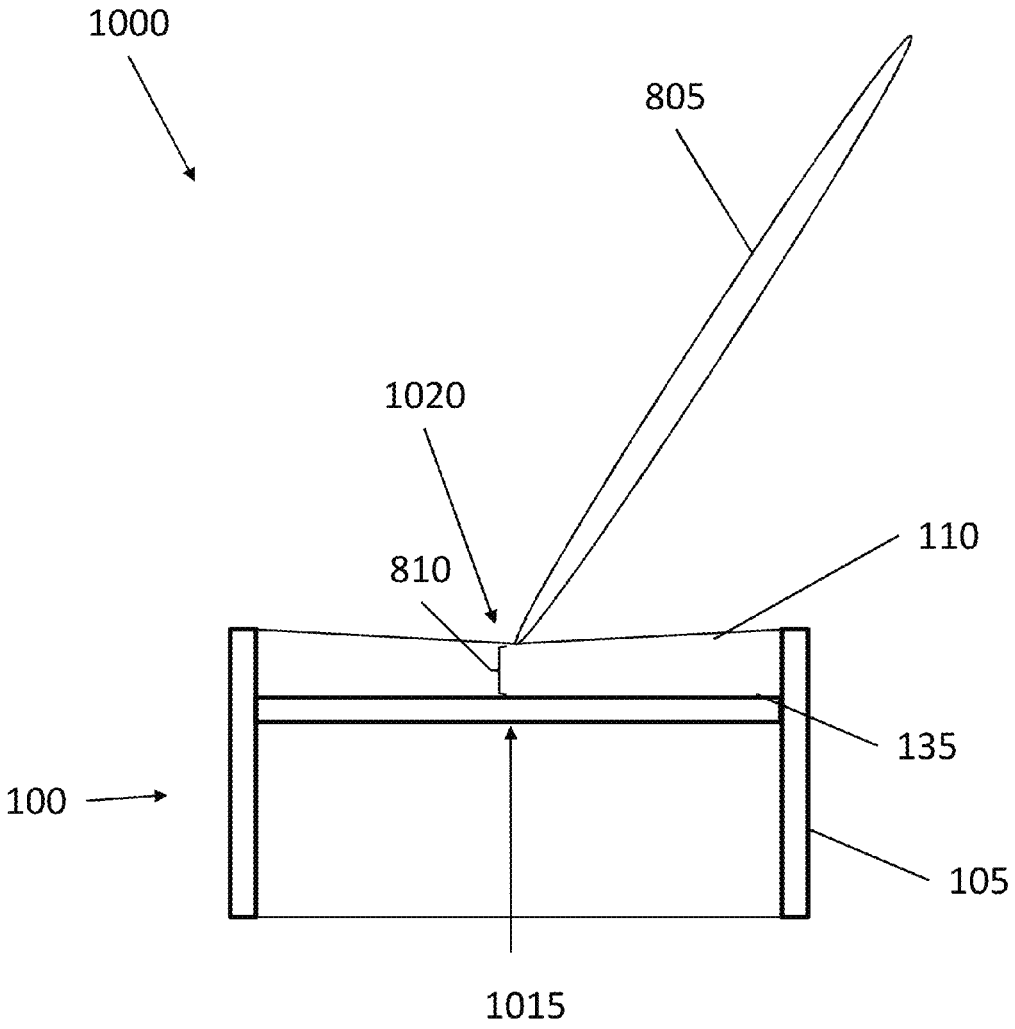
FIG. 10 is a further schematic depiction of a drum stick impacting a drum in accordance with aspects of the disclosure.

FIG. 10 schematically depicts another arrangement 1000 in which a drum stick 805 is impacting a drum head 110 of the drum 105. As shown in FIG. 10, upon being impacted (e.g., by a drumstick 805), the drum head 110 is moved downwardly (e.g., deflected) at the impact site 1020. The detector 135 is operable to measure the distance 810 between the inductive surface of the detector 135 and the flexible conductor (not shown) arranged on the lower side of the drum head 110. Additionally, if the drum utilizes a plurality of zones, the detector 135 is operable to determine the relative location 1015 on the detector 135 (in x and y directions) corresponding to the impact site 1020. Based on the measured distance 810, the drum (in conjunction with a processor) is operable to determine a relative volume of the drum impact.

In comparison to FIG. 8, with FIG. 10, the drum 100 has been impacted to approximately the same extent, and thus, distance 810 is the same in both FIGS. 9 and 10. As can also be observed, the impact sites are different between FIGS. 8 and 10. Accordingly, with the example of FIG. 10, the sound creation processor (not shown), which is operable to produce the sounds based on the received inputs, will produce a drum sound with a volume that is approximately the same as the drum sound volume produced with the example of FIG. 8. As a different zone is impacted in FIGS. 8 and 10, however, the sound creation processor (not shown) may adjust the produced sound (e.g., provide a different tone for that particular drum or a completely different tone) based on the impact zone.

While the drums have been described as including zones, the disclosure contemplates that some drums may not utilize zones. For example, some drums (e.g., kick drums) tend to be struck in the same location based on the impact point of a foot pedal. That is, while a drummer may utilize his drum sticks impacting different regions of a snare drum head to generate different tones, the foot pedal for a kick drum may be configured to impact the drum in a same location. As such, the disclosure contemplates that some drums may not be configured to detect different zones of impact.

Figure 11:
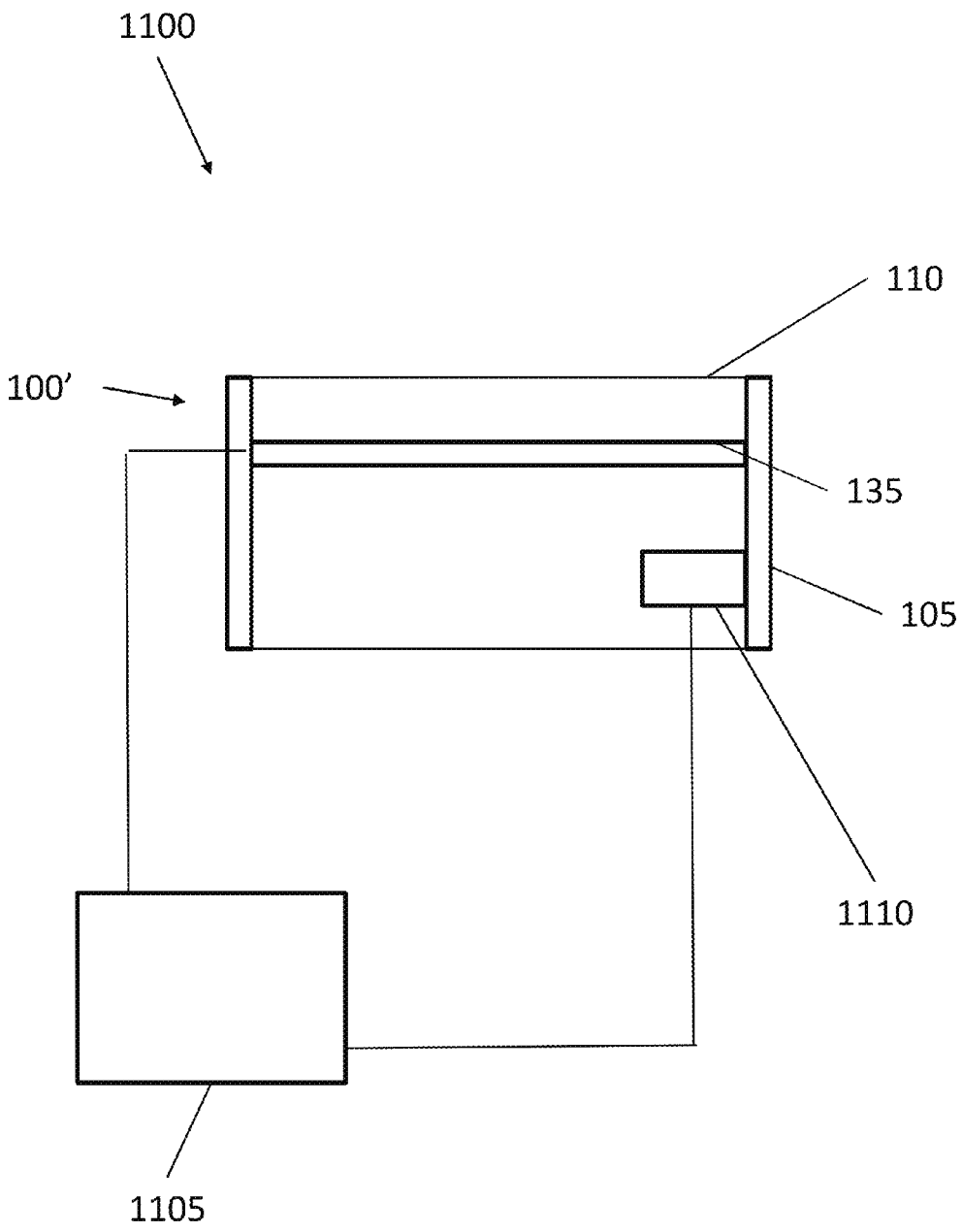
FIG. 11 is a schematic sectional view of a drum in accordance with aspects of the disclosure.

FIG. 11 illustrates an exemplary drum arrangement 1100 in accordance with aspects of the disclosure. As shown in FIG. 11, a drum 100' may be connected to a sound creation processor 1105 configured and operable to receive one or more electric signals generated by the detector 135, and convert them into e.g., percussion sounds, which may then be output through an amplifier and speaker arrangement (not shown). The detector 135 is employed to accurately produce each stroke (e.g., from subtle ghost notes to driving rock patterns). In embodiments, the detector 135 is designed to work with any sound module or trigger to MIDI interface (TMI). The detector 135 also enables integrated wiring, meaning there is no exposed wiring from the sensor (or detector) 135 to a connector jack (e.g., 3.5 mm, ¼" jack, and/or usb port). Additional embodiments may utilize wireless communication protocols (e.g., WiFi or Bluetooth) to send and receive data (e.g., measured distance and zone information) between, for example the detector 135 and the sound creation processor 1105.

As shown in FIG. 11, in some embodiments, the drum 100' may also include a piezo transducer arrangement 1110, structured and arranged to detect a vibration or impact to the drum shell 105. In embodiments, the rim of the drum may include a layer of rubber thereon (not shown) configured and arranged to cause the stick to bounce back upon impact. The piezo transducer arrangement 1110 is also electrically connected to the sound creation processor 1105. For example, with a rim shot, the rim of the drum (or the rubber layer arranged on the rim of the drum) is impacted. By utilizing the piezo transducer arrangement 1110, the drum 100' is operable to detect impacts to the rim, which is sent to the sound creation processor 1105 to reproduce, e.g., the rim shot sound.

By implementing aspects of the disclosure, performance and playability akin to an acoustic drum is achievable, due to, for example, the head and sensor design. Additionally, the embodiments of the present disclosure enable a tension adjustable head. By implementing further aspects of the disclosure, wood drum shells may be utilized for accurate roundness, and bearing edges may be provided for proper head seating and adjustment. The wood shells also enable lacquer finishes having an appearance of acoustic drums. The head design enables quiet play. Additionally, the head design may be configured to provide multiple zones of the drum with no crosstalk there between, and the ability to achieve tonality of a drum across the playing surface. Implementing further aspects of the disclosure, enables assignments of any sound at any zone, wherein various zone patterns may be created for various applications. For example, with a drum configured with a detector having four quadrants (e.g., as shown in FIG. 6). may be configured to produce two conga sounds (e.g., left and right) and two bongo sounds (e.g., left and right). Furthermore, by implementing the piezo sensor in conjunction with the inductive detector, discrete triggering from rim of drum with no crosstalk between main head and rim (or from drum to drum) can be achieved. Additionally, by implementing aspects of the disclosure, the sensitivity of a stroke is determined by accurately measuring the head deflection.

In embodiments, the present disclosure may be applied to, for example, different types of drums, including tom-toms (e.g., floor toms or mounted toms), the bass (or kick) drum, and the snare drum. In embodiments, each of these drums may utilize similar components: all wood shells, 3-ply woven drumheads, and an inductive detector system. Since each drum comes in different diameters, depths, and stroke method, the sensor systems of the respective drums may have different shape and sizes. In embodiments, the disclosure contemplates multiple sensors may be used on a single drum. For example, an additional sensor may be applied for utilizing the rim of the drum for a triggered surface (e.g., as in the case of Snare drums), but can be easily applied to all drums. While the specification describes all wood drum shells, it should be understood that the disclosure contemplates other drum shell materials, (e.g., metal, plastic, composites, etc.). Additionally, while the specification describes birch, the disclosure contemplates other wood materials may be used, e.g. maple, oak, a combination of different woods, and also contemplates that different drums may use different materials (e.g., a tom-tom drum made of birch, and a bass drum made of maple). In embodiments, the torn-toms (or the other drums) may include different diameter shell sizes, (e.g., 8", 10", and 12" diameters).

By implementing aspects of the disclosure, a user will have a playing experience that closely approximates or mimics the feel, look, playability, and tonal response of acoustic drums. Utilizing wood shell drums allows for the look of acoustic drums and will maintain its true roundness and proper head seating.

Implementing aspects of the disclosure enables an accurate reproduction of each stroke from the drum stick that can detail the nuances of the player's performance. In some embodiments, a vibration sensor mounting design may be used to account for vibration and aesthetics in a wood shell drum. By utilizing the head technology, which causes accurate bounces off the head surface when struck, a user achieves the feel of normal acoustic drum experience. In accordance with aspects of the disclosure, the drum head can be adjusted to accurately reflect drum stick or drummer response to be similar to an acoustic drum head material. Thus, by implementing aspects of the present disclosure, electronic drums that look, feel, and play like acoustic drums are attainable.

Exemplary Drum Shells

Figure 12:
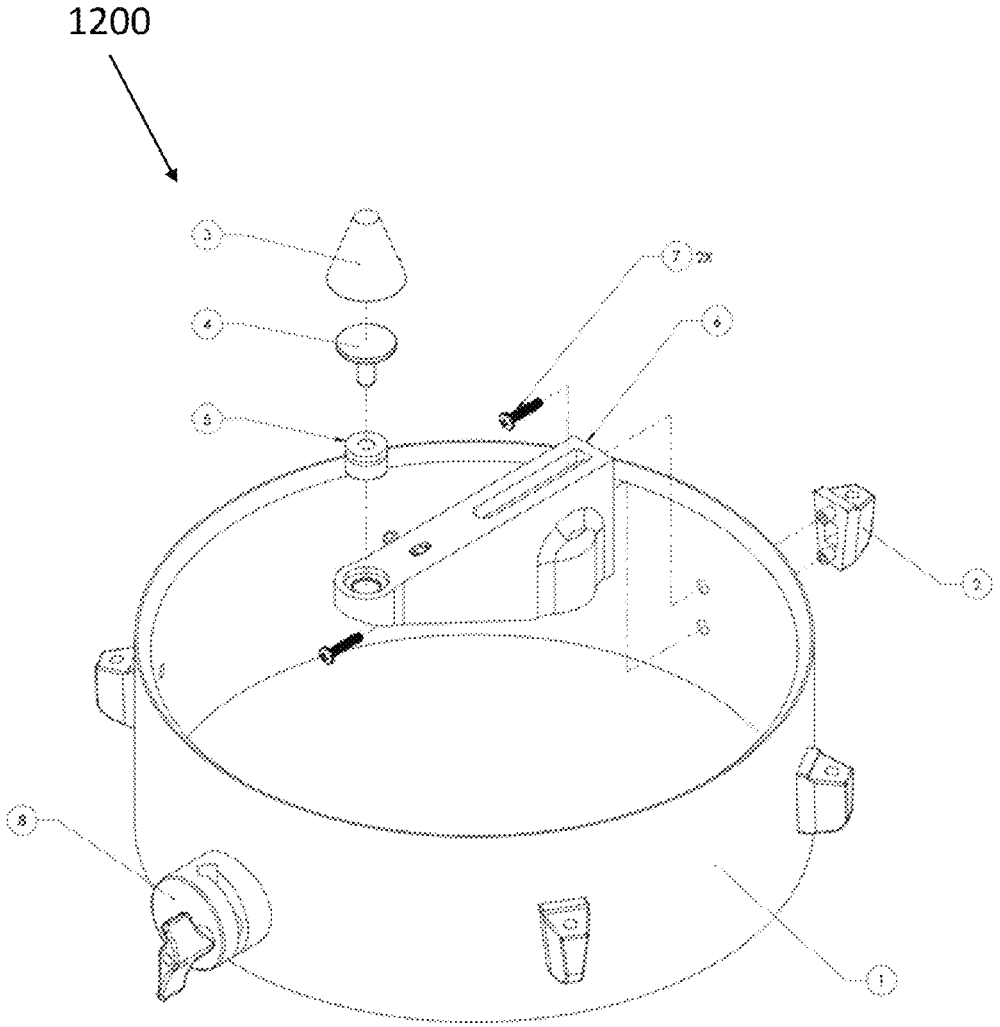
FIG. 12 shows a perspective view of a tom-tom drum in accordance with aspects of the disclosure.

FIG. 12 is a perspective exploded view 1200 of a tom-tom drum shell 1 having a vibration sensor. While not shown in FIG. 12, the exemplary drum shell 1 may be used with the inductive detector in accordance with aspects of the disclosure. As shown in FIG. 12, this drum shell 1 includes a sensor mount 6 (e.g., an integrated sensor mount configured to house all the sub components to form a complete module) that integrates all sensor wiring internal to the housing body. The sensor mount 6 includes an anti-vibration element 5 mounted to reduce both lateral and vertical vibration. It should be understood that with vibration sensors, vibration can cause false triggering, resulting in a false sound being generated. This can be caused by striking another drum or device in proximity that will cause vibration to trigger another drum via direct coupled sources. The anti-vibration element 5 reduces the likelihood of false triggering. Direct mounting of the sensor mount 6 through the drum shell 1 to the drum lug 2 using lugs 7 allows for a stable mounting technique that requires no additional holes to be drilled into the drum shell 1. This provides an aesthetic look that closely resembles an acoustic drum. The sensor 3 is mounted to the sensor platform 4 in such a manner that reduces the vibration that can be caused by the interaction from striking the shell (secondary) sensor. This novel approach allows for secure mounting while reducing shell vibration. This allows for an accurate and sensitive reproduction of the stroke produced by the drumstick striking the 3-ply woven head. While not shown in FIG. 12, a vibration sensor 3 may be arranged to contact the drum head (e.g., the 3-ply head). This sensor mount arrangement will also enable adding one or more additional sensors to the Tom Toms, if desired, without vibration causing crosstalk between the respective sensors. As shown in FIG. 12, the drum also includes a stand mount 8 structured and arranged for accommodating a stand for proper placement of the drum.

Figure 13:
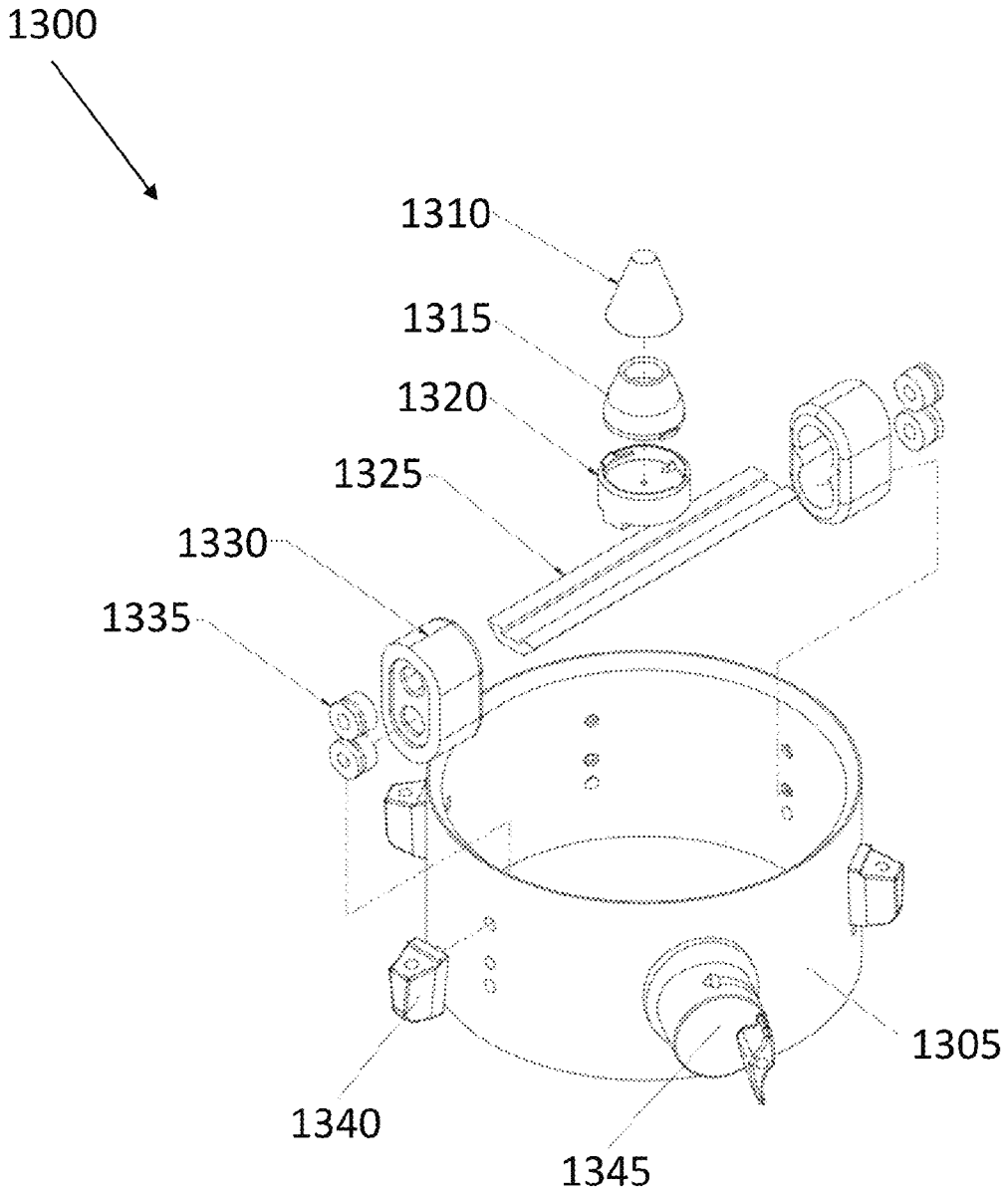
FIG. 13 shows a perspective view of a snare drum in accordance with aspects of the disclosure.

FIG. 13 is a perspective exploded view 1300 of a snare drum shell 1305 having a vibration sensor. While not shown in FIG. 13, the exemplary drum shell 1305 may be used with the field resistance inductive detector in accordance with aspects of the disclosure. As shown in FIG. 13, the drum shell 1305 includes a vibration sensor 1310 mounted to the sensor holder 1320, which is mounted to bar 1325 (e.g., an extruded aluminum bar), which allows for precise and adjustable positioning of the sensor 1310 laterally. In embodiments, the height of the sensor 1310 may be fixed by the sensor bar holder 1330 along the bar 1325. Sensor cover 1315 covers the sensor walls, and protects the sensor 1310 from extreme pressure. The sensor bar holder 1330 houses vibration mounts 1335 to alleviate vibration through the shell 1305 a rim sensor (not shown, see FIG. 11) mounted to the shell, being struck. As shown in FIG. 13, the drum shell 1305 includes also includes a stand mount 1345 and drum lugs 1340.

Figure 14:
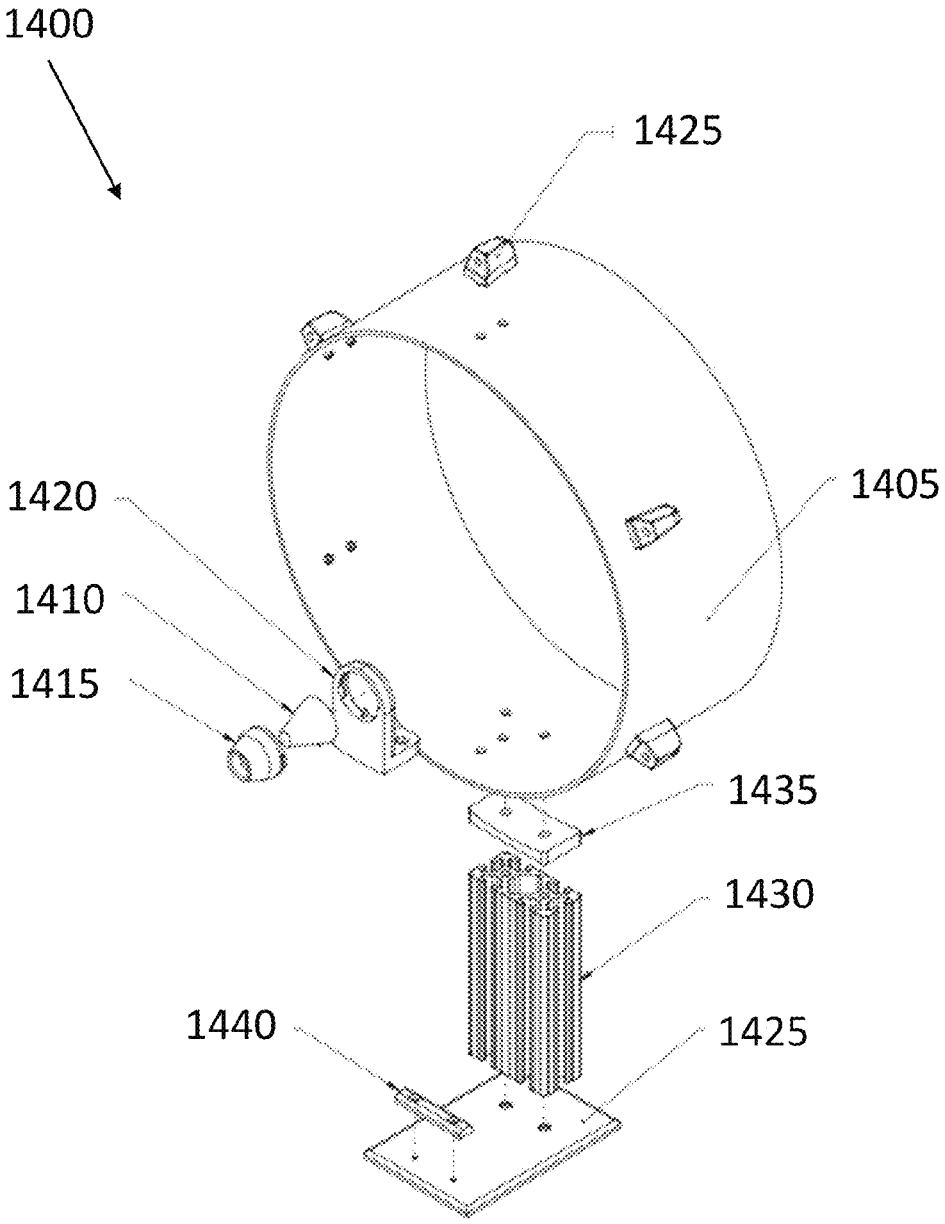
FIG. 14 shows a perspective view of a kick (or bass) drum in accordance with aspects of the disclosure.

FIG. 14 is a perspective exploded view 1400 of a kick (or bass) drum shell 1405 having a vibration sensor. While not shown in FIG. 14, the exemplary drum shell 1405 may be used with the field resistance inductive detector in accordance with aspects of the disclosure. As shown in FIG. 14, the drum shell 1405 includes a vibration sensor 1410 mounted to the sensor mount 1420, which is contoured to approximately (and, in embodiments, exactly) fit the curve of the inner shell wall of the shell 1405.

As shown in FIG. 14, the sensor mount 1420, holds the sensor 1410 in place and channels the sensor wiring to an output jack. A sensor cover 1415 covers the sensor walls, and protects the sensor 1410 from extreme pressure. In embodiments, the sensor 1410 is a ceramic-based sensor. The drum 1400 also includes a base 1425, a riser 1430 attached (e.g., fastened or welded) to the base 1425, and a mounting attachment 1435 attached to the other end of the riser 1430. As shown in FIG. 14, the mounting attachment 1435 is securely attached to the drum shell 1405. The base 1425 also includes a bar 1440 attached thereto, and structured and arranged for attaching and/or securing and/or supporting a foot pedal. The drum shell 1405 also includes drum lugs 1445.

While not shown in some of the exemplary depictions of the drum, the drum (or a group of drums) may include a processor configured and operable to receive the measured distance and zone location information from the inductive detector, convert the received information into suitable control signals (e.g., A/D convertor operable to convert analog signal to a digital MIDI signals {e.g., 0-127}) for generating a sound (e.g., within the processor or with a separate sound creator), and transmitting the control signals to the internal or external sound creator.

Process for Operating a Drum

Figure 15:
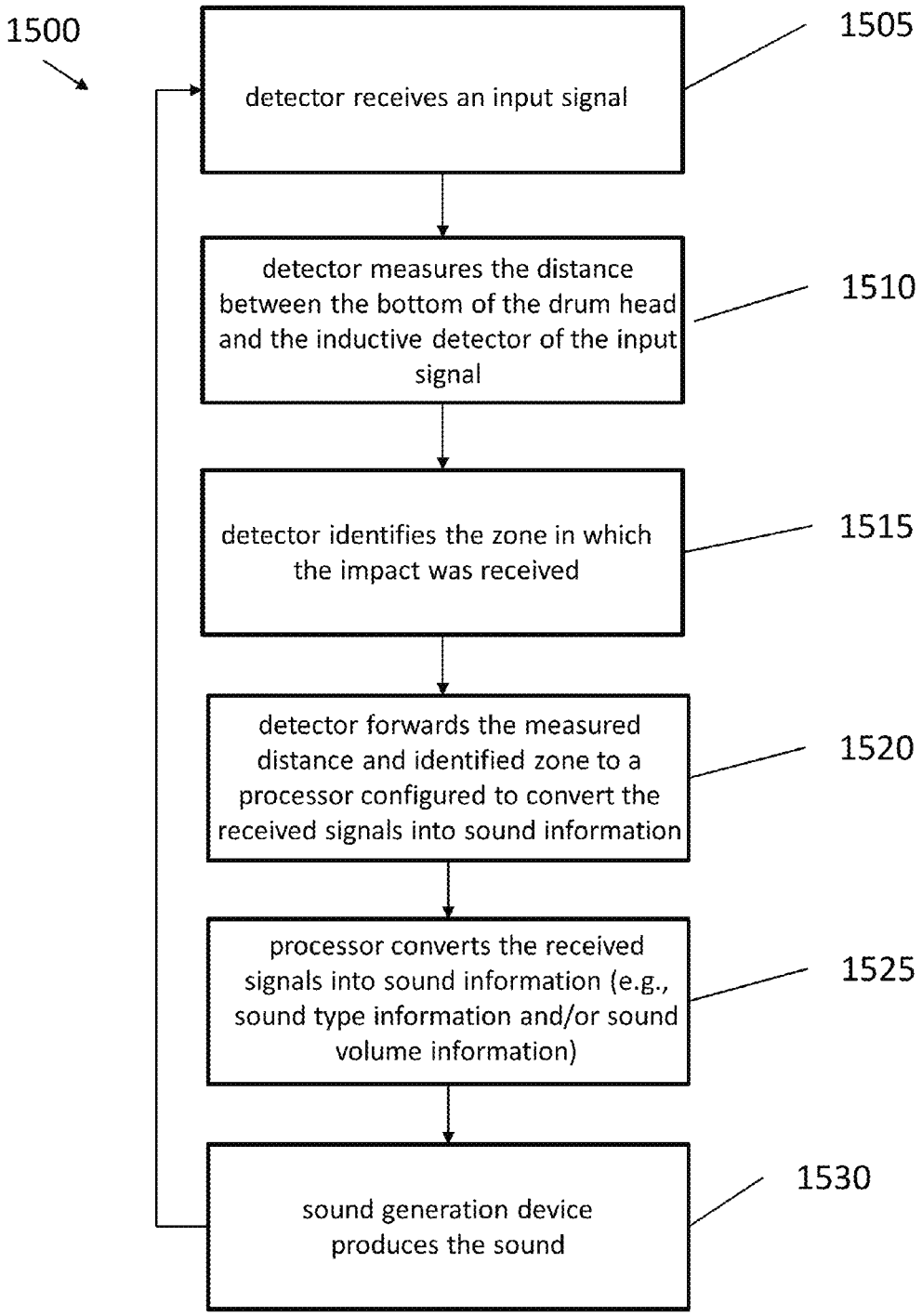
FIG. 15 depicts a process for operating a drum in accordance with aspects of the disclosure.

FIG. 15 depicts an exemplary process 1500 in accordance with aspects of the disclosure. As shown in FIG. 15, at step 1505 the detector receives an input signal. At step 1510, the detector measures the distance between the bottom of the drum head and the inductive detector of the input signal. At step 1515, the detector identifies the zone in which the impact was received. At step 1520, the detector forwards the measured distance and identified zone to a processor configured to convert the received signals into sound information (e.g., sound type information and/or sound volume information). At step 1525, the processor converts the received signals into sound information (e.g., sound type information and/or sound volume information). At step 1530, sound information is received by a sound generation device operable to produce the sounds based on the sound information, and the sound generation device produces the sound. After step 1530, the process continues at step 1505. It should be understood that the exemplary process is an on-going process that occurs in real-time as a drummer continues to strike the drum(s). In certain embodiments a filter may be used to filter the input signal so as to only capture a rising edge attack of the input signal, while filtering out subsequent decaying signals. By doing so, the filter is operable to detect the distance at the maximum deflection point for each impact.

Convertible Drums

Additional aspects of the present disclosure are directed to convertible drums that may be configured to operate as acoustic drums and electronic drums. For example, with one non-limiting embodiment, the drum may include two heads, one on each end of the drum, wherein one of the drum heads is an acoustic drum head, and the other drum head is the three-ply plus conducting layer drum head, with an inductive detector arranged below the three-ply plus conducting layer drum head. With further contemplated convertible drum embodiments, the electronic drum head may be configured for, e.g., quick, removal from the drum shell, and configured to receive an acoustic drum head. As the drum shells comprise wood shells and are structured and configured to mimic the playability and feel of acoustic drums, utilizing acoustic drum heads may produce desirable acoustic drum tones. By implementing these aspects of the disclosure, a drum may be configured for either acoustic or electronic operation depending on a user's current needs or environmental constraints.

System Environment

Aspects of embodiments of the present disclosure (e.g., one or more aspects of the detector and/or the sound creation processor) can be implemented by such special purpose hardware-based systems that perform the specified functions or acts, or combinations of special purpose hardware and computer instructions and/or software, as described above. The control systems may be implemented and executed from either a server, in a client server relationship, or they may run on a user workstation with operative information conveyed to the user workstation. In an embodiment, the software elements include firmware, resident software, microcode, etc.

As will be appreciated by one skilled in the art, aspects of the present disclosure may be embodied as a system, a method or a computer program product. Accordingly, aspects of embodiments of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present disclosure (e.g., sound creation processor) may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following:

- an electrical connection having one or more wires,
- a portable computer diskette,
- a hard disk,
- a random access memory (RAM),
- a read-only memory (ROM),
- an erasable programmable read-only memory (EPROM or Flash memory),
- an optical fiber,
- a portable compact disc read-only memory (CDROM),
- an optical storage device,
- a transmission media such as those supporting the Internet or an intranet,
- a magnetic storage device
- a usb key, and/or
- a mobile phone.

In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network. This may include, for example, a local area network (LAN) or a wide area network (WAN), or the connection may be made to an external computer (for example, through the Internet using an Internet Service Provider). Additionally, in embodiments, the present invention may be embodied in a field programmable gate array (FPGA).

Figure 16:
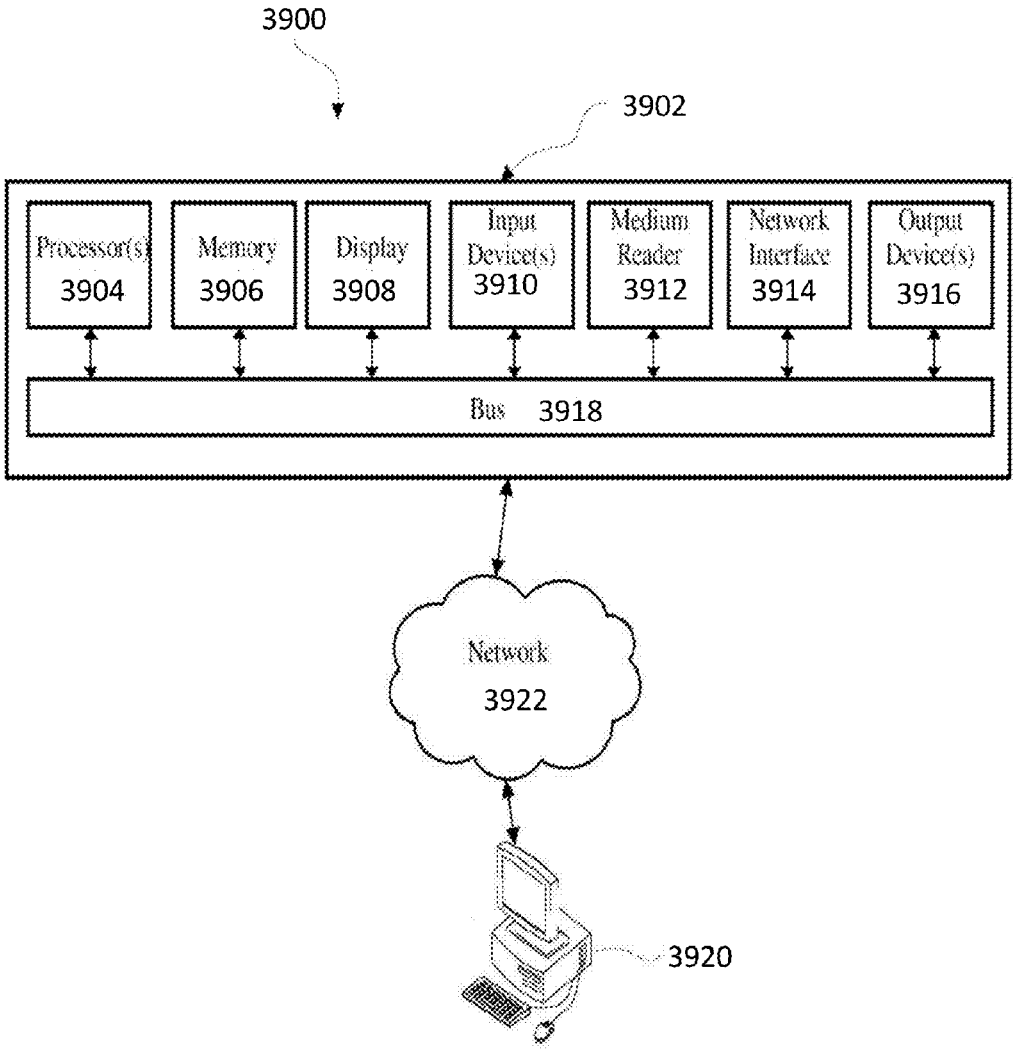
FIG. 16 depicts a system environment for performing aspects of the disclosure.

FIG. 16 is an exemplary system for use in accordance with the embodiments described herein. The system 3900 is generally shown and may include a computer system 3902, which is generally indicated. The computer system 3902 may operate as a standalone device or may be connected to other systems or peripheral devices. For example, the computer system 3902 may include, or be included within, any one or more computers, servers, systems, communication networks or cloud environment.

The computer system 3902 may operate in the capacity of a server in a network environment, or in the capacity of a client user computer in the network environment. The computer system 3902, or portions thereof, may be implemented as, or incorporated into, various devices, such as a personal computer, a tablet computer, a set-top box, a personal digital assistant, a mobile device, a palmtop computer, a laptop computer, a desktop computer, a communications device, a wireless telephone, a personal trusted device, a web appliance, or any other machine capable of executing a set of instructions (sequential or otherwise) that specify actions to be taken by that device. Further, while a single computer system 3902 is illustrated, additional embodiments may include any collection of systems or sub-systems that individually or jointly execute instructions or perform functions.

As illustrated in FIG. 16, the computer system 3902 may include at least one processor 3904, such as, for example, a central processing unit, a graphics processing unit, or both. The computer system 3902 may also include a computer memory 3906. The computer memory 3906 may include a static memory, a dynamic memory, or both. The computer memory 3906 may additionally or alternatively include a hard disk, random access memory, a cache, or any combination thereof. Of course, those skilled in the art appreciate that the computer memory 3906 may comprise any combination of known memories or a single storage.

As shown in FIG. 16, the computer system 3902 may include a computer display such as a liquid crystal display, an organic light emitting diode, a flat panel display, a solid state display, a cathode ray tube, a plasma display, or any other known display. The computer system 3902 may include at least one computer input device 3910, such as a keyboard, a remote control device having a wireless keypad, a microphone coupled to a speech recognition engine, a camera such as a video camera or still camera, a cursor control device, or any combination thereof. Those skilled in the art appreciate that various embodiments of the computer system 3902 may include multiple input devices 3910. Moreover, those skilled in the art further appreciate that the above-listed, exemplary input devices 3910 are not meant to be exhaustive and that the computer system 3902 may include any additional, or alternative, input devices 3910.

The computer system 3902 may also include a medium reader 3912 and a network interface 3914. Furthermore, the computer system 3902 may include any additional devices, components, parts, peripherals, hardware, software or any combination thereof which are commonly known and understood as being included with or within a computer system, such as, but not limited to, an output device 3916. The output device 3916 may be, but is not limited to, a speaker, an audio out, a video out, a remote control output, or any combination thereof.

Furthermore, the aspects of the disclosure may take the form of a computer program product accessible from a computer-usable or computer-readable medium providing program code for use by or in connection with a computer or any instruction execution system. The software and/or computer program product can be implemented in the environment of FIG. 16. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable storage medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disc-read/write (CD-R/W) and DVD.

Although the present specification describes components and functions that may be implemented in particular embodiments with reference to particular standards and protocols, the disclosure is not limited to such standards and protocols. Such standards are periodically superseded by faster or more efficient equivalents having essentially the same functions. Accordingly, replacement standards and protocols having the same or similar functions are considered equivalents thereof.

The illustrations of the embodiments described herein are intended to provide a general understanding of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

Accordingly, the present disclosure provides various systems, structures, methods, and apparatuses. Although the disclosure has been described with reference to several exemplary embodiments, it is understood that the words that have been used are words of description and illustration, rather than words of limitation. Changes may be made within the purview of the appended claims, as presently stated and as amended, without departing from the scope and spirit of the disclosure in its aspects. Although the disclosure has been described with reference to particular materials and embodiments, embodiments of the disclosure are not intended to be limited to the particulars disclosed; rather the disclosure extends to all functionally equivalent structures, methods, and uses such as are within the scope of the appended claims.

While the computer-readable medium may be described as a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the embodiments disclosed herein.

The computer-readable medium may comprise a non-transitory computer-readable medium or media and/or comprise a transitory computer-readable medium or media. In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk, tapes or other storage device to capture carrier wave signals such as a signal communicated over a transmission medium. Accordingly, the disclosure is considered to include any computer-readable medium or other equivalents and successor media, in which data or instructions may be stored.

Although the present application describes specific embodiments which may be implemented as code segments in computer-readable media, it is to be understood that dedicated hardware implementations, such as application specific integrated circuits, programmable logic arrays and other hardware devices, can be constructed to implement one or more of the embodiments described herein. Applications that may include the various embodiments set forth herein may broadly include a variety of electronic and computer systems. Accordingly, the present application may encompass software, firmware, and hardware implementations, or combinations thereof.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure has been described with reference to specific embodiments, those skilled in the art will understand that various changes may be made and equivalents may be substituted for elements thereof without departing from the true spirit and scope of the disclosure. While exemplary embodiments are described above, it is not intended that these embodiments describe all possible forms of the invention. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

What is claimed is:

1. An electronic drum comprising:

a shell having a plurality of drum lugs;

a plurality of tension rods;

a drum head mounted to the shell;

a rim arranged over the drum head and fastened to the plurality of drum lugs with the plurality of tension rods so as to tension the drum head over the shell; and at least one distance detector arranged below the tensioned drum head and configured to detect and quantify a change in distance between the distance detector and the tensioned drum head.

2. The electronic drum of claim 1, wherein the distance detector comprises at least one inductive coil.

3. The electronic drum of claim 1, wherein the drum head comprises a three-ply structure.

4. The electronic drum of claim 1, wherein the drum head comprises a conductive layer.

5. The electronic drum of claim 4, wherein the conductive layer is arranged on an internal surface of the drum head.

6. The electronic drum of claim 4, wherein the conductive layer comprises a silver mesh layer.

7. The electronic drum of claim 2, wherein the at least one inductive coil comprises a plurality of inductive coils arranged to delineate a plurality of impact detection zones of the distance detector.

8. The electronic drum of claim 7, wherein the plurality of impact detection zones comprise a plurality of concentric circles.

9. The electronic drum of claim 7, wherein the plurality of impact detection zones comprise a plurality of quadrants.

10. The electronic drum of claim 1, further comprising a processor configured to receive a detected distance and convert the detected distance to a volume signal.

11. The electronic drum of claim 10, further comprising a sound generator operable to receive the volume signal and output a sound based on the volume signal.

12. The electronic drum of claim 10, wherein the processor is additionally configured to receive a detected impact zone and convert the detected impact zone to a sound-type signal.

13. The electronic drum of claim 12, further comprising a sound generator operable to receive the volume signal and the sound-type signal and output a sound based on the volume signal and the sound-type signal.

14. The electronic drum of claim 1, wherein the change in distance is measurable when the drum head is impacted.

15. The electronic drum of claim 1, wherein the change in distance is measurable for each drum stroke impact with the drum head.

16. The electronic drum of claim 1, wherein the at least one distance detector is configured with a measurement resolution in the picometer range.

17. The electronic drum of claim 1, wherein the at least one distance detector comprises a circuit configured to measure changes in inductance.

18. The electronic drum of claim 1, wherein the drum head comprises:

a three-ply structure with a first layer and a third layer of a first material and a second layer comprising a second material that is different than the first material; and a conductive layer comprising a wire mesh adhered to the three-ply structure.

19. A method of producing a sound from the drum of claim 1, the method comprising:

measuring a change in distance between an impact-receiving material and a detection surface spaced from the impact-receiving material due to an impact to the impact-receiving material using the at least one distance detector;

converting the measured change in distance to sound volume quantification data using a processor; and producing the sound at least partially in dependence upon the sound volume quantification data.

20. The method of claim 19, further comprising:

detecting an impact zone for the impact to the impact-receiving material;

converting the detected impact zone to sound type data using the processor; and producing the sound at least partially in dependence upon the sound type data.

* * * * *